US007793778B2

(12) United States Patent
Olsen

(10) Patent No.: US 7,793,778 B2
(45) Date of Patent: Sep. 14, 2010

(54) CONTAINER CARRIER

(75) Inventor: Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/098,791

(22) Filed: Apr. 7, 2008

(65) Prior Publication Data

US 2008/0245680 A1 Oct. 9, 2008

Related U.S. Application Data

(60) Provisional application No. 60/922,212, filed on Apr. 6, 2007.

(51) Int. Cl.
*B65D 75/62* (2006.01)

(52) U.S. Cl. ..... 206/150; 206/151; 294/87.2

(58) Field of Classification Search ..... 206/145, 206/147, 150, 151, 170, 427; 294/87.2
See application file for complete search history.

(56) References Cited

U.S. PATENT DOCUMENTS

| | | | | | |
|---|---|---|---|---|---|
| 4,064,989 | A | * | 12/1977 | Olsen | 206/151 |
| 4,592,466 | A | * | 6/1986 | Walters et al. | 206/150 |
| 5,072,829 | A | * | 12/1991 | Marco et al. | 206/150 |
| 5,098,144 | A | * | 3/1992 | Marvin | 206/150 |
| 5,209,346 | A | * | 5/1993 | Pratt et al. | 206/150 |
| 5,255,780 | A | * | 10/1993 | Olsen | 206/150 |
| 5,261,530 | A | * | 11/1993 | Marco | 206/150 |
| 5,265,718 | A | | 11/1993 | Marco | |
| 5,305,877 | A | * | 4/1994 | Olsen | 206/150 |
| 5,474,173 | A | * | 12/1995 | Hodapp | 206/150 |
| 2007/0296231 | A1 | * | 12/2007 | Borg | 294/87.2 |

* cited by examiner

*Primary Examiner*—Luan K Bui
(74) *Attorney, Agent, or Firm*—Pauley Petersen & Erickson

(57) ABSTRACT

A carrier and method of manufacture for a carrier that results in a package of containers includes a plastic sheet having an array of container apertures and an inner web. The inner web includes a flap that impinges into each container aperture thus creating a carrier that may be consistently applied to produce a desirable package.

11 Claims, 2 Drawing Sheets

CONTAINER CARRIER

CROSS REFERENCE TO RELATED APPLICATION

This Application claims priority to Provisional Patent Application Ser. No. 60/922,212, filed 6 Apr. 2007.

BACKGROUND OF THE INVENTION

1. Field of the Invention

This invention relates to a carrier used to unitize a plurality of containers such as cans or bottles.

2. Description of Prior Art

Container carriers, such as the carrier according to this invention, are used to unitize a plurality of containers. Typical containers are bottles, cans and other containers having a sidewall and a chime or raised rib around an upper portion of the container. Much of the prior art in this area, specifically container carriers constructed from polymeric materials, comprises devices that engage the chime or rib around the upper portion of the container. Another style of container carrier is the sidewall-applied carrier wherein the carrier engages the sidewall of the container.

Regardless of the style of container carrier, one challenge in the art is to provide a container carrier that can be used with a variety of containers, including different container diameters and containers having sidewalls with different qualities. In addition, such container carriers should promote a consistent application to a variety of containers resulting in a package that is tight and compact and thus desirable to the consumer.

SUMMARY OF THE INVENTION

A carrier according to one preferred embodiment of this invention is constructed from a generally flexible plastic sheet that is preferably generally transparent and includes an array of container apertures, each container aperture in the array for engaging a container. The container apertures are preferably arranged in transversely adjacent pairs.

An inner web is preferably formed between each transversely adjacent pair of container apertures. The inner web preferably includes a flap extending into each container aperture. The flap is preferably a generally curved portion that extends across a central portion of an inner edge of each container aperture.

A line of weakness also preferably extends across a center of the inner web. The inner web is preferably symmetrical about the line of weakness, which may comprise a series of perforations or slits.

As a result of the described configuration of the carrier, a consistent package of containers is created because the inner web consistently forms in a "V" shape and resists skewing or inverting. Such skewing or inverting may occur in conventionally designed carriers when the carrier is applied to smaller diameter containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
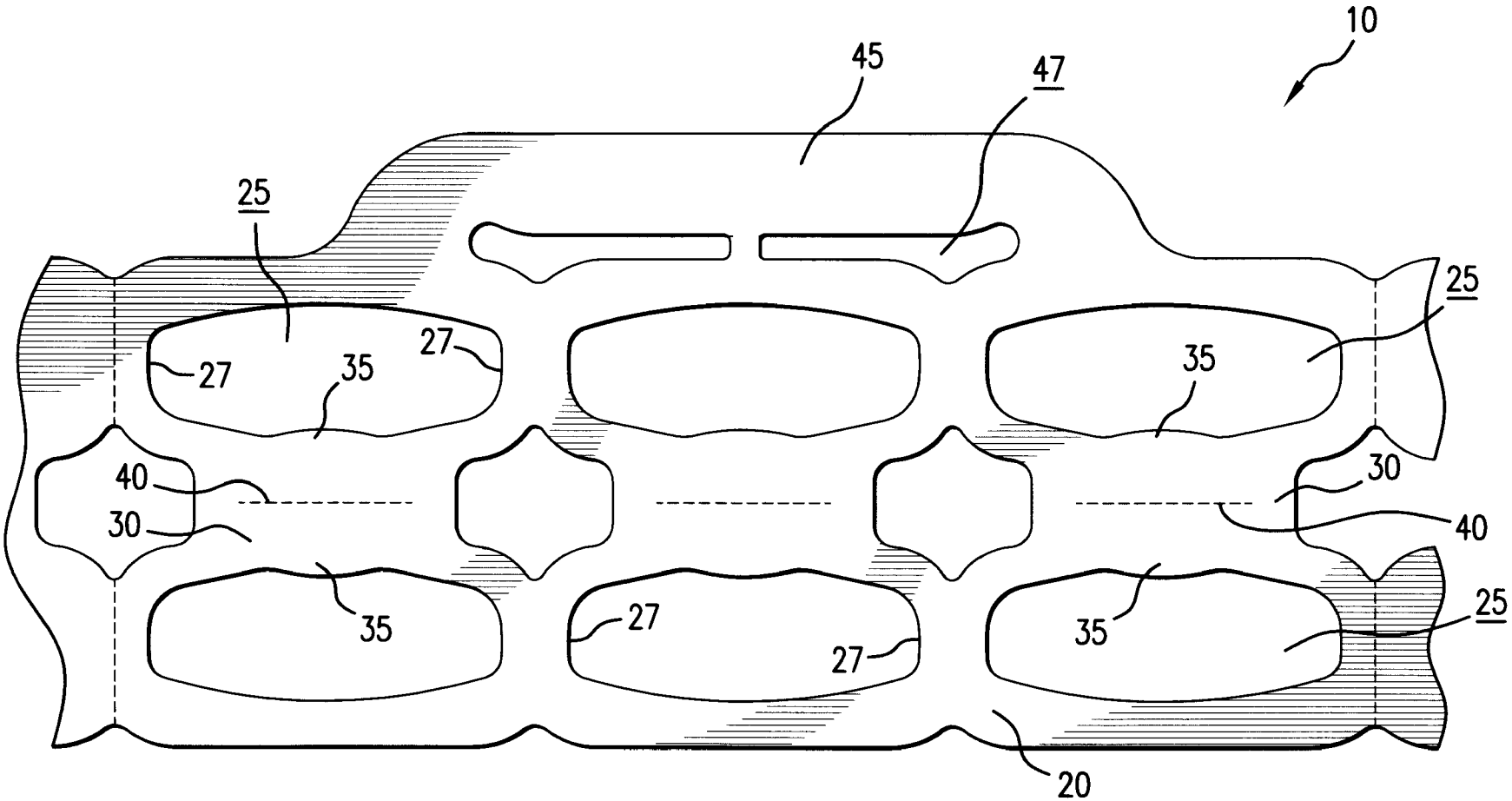
FIG. 1 is a side elevational view of a container carrier according to one preferred embodiment of this invention.
Figure 2:
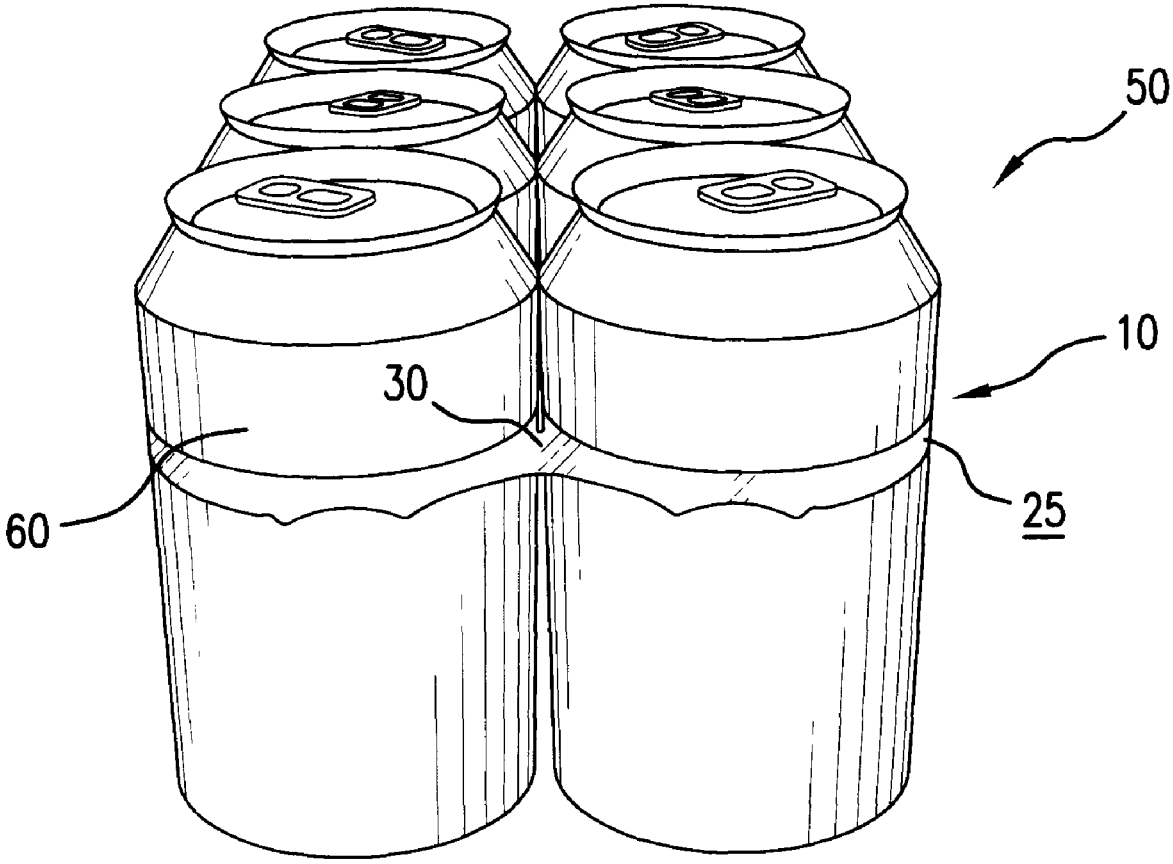
FIG. 2 is a front perspective view of a package of containers according to one preferred embodiment of this invention.

FIG. 1 shows a representative carrier for carrying an array of containers and FIG. 2 shows a resulting package according to various preferred embodiments of this invention. The physical configuration of carrier 10 and package 50 is merely illustrative and may be varied without departing from the principles of this invention.

In a manner similar to the types of multi-package carriers described above, carrier 10 according to one preferred embodiment of this invention is constructed from a thermoplastic material, preferably an extruded low- to medium-density polyethylene sheet material, or plastic sheet 20 having a generally smooth surface. Plastic sheet 20 is preferably generally transparent. As is common in plastic extrusion, plastic sheet 20 is extruded such that a longitudinal direction of plastic sheet 20 is in a machine direction, by definition the direction of the extrusion that is perpendicular to the face of an extrusion die, and the lateral dimension of plastic sheet 20 is in a transverse direction, the direction of the extrusion that is parallel with the extrusion die.

Plastic sheet 20 is preferably die-cut to form a plurality of apertures 25, each aperture 25 capable of receiving container 60. Apertures 25 are preferably arranged in an array of lateral rows and longitudinal ranks. As shown in FIGS. 1 and 2, a preferable array is an arrangement of two lateral rows and three longitudinal ranks to form carrier 10 for holding six containers 60. Accordingly, rows of apertures 25, although extending lengthwise across plastic sheet 20, are counted laterally across a width of plastic sheet 20 and ranks of apertures 25, although extending widthwise across plastic sheet 20, are counted longitudinally along a length of plastic sheet 20. It should be noted, however, that although FIGS. 1 and 2 show carrier 10 for holding six containers 60, the invention is not intended to be so limited and carrier 10 may contain any feasible array of apertures 25.

Apertures 25 may comprise any suitable opening, preferably, though not necessarily, an elongated opening having an elongation in the longitudinal direction. As shown in FIG. 1, apertures 25 are narrower in the lateral direction than in the longitudinal direction. According to one preferred embodiment of this invention, each container aperture 25 further comprises two generally straight edges 27 extending in a transverse direction of plastic sheet 20.

As shown and described, container apertures 25 are preferably formed in plastic sheet 20 in transversely adjacent pairs with inner web 30 positioned between each transversely adjacent pair of container apertures 25. Inner web 30 preferably includes flap 35 extending into each container aperture 25 of each adjacent pair of container apertures 25. As shown in FIG. 1, flap 35 is preferably a generally curved portion that extends across a central portion of an inner edge of each container aperture 25.

Line of weakness 40 extending across a center of inner web 30. As shown in FIG. 1, inner web 30 is preferably symmetrical about line of weakness 40. According to one preferred embodiment of this invention, the line of weakness 40 comprises a perforation, however, line of weakness 40 may comprise any suitable arrangement of perforations, slits, scores, a reduction in thickness of flexible sheet 20 or any other similar line of weakness 40 known to those having ordinary skill in the art.

Handle 45 preferably extends from one longitudinal edge of plastic sheet 20. Handle 45 may be integrally formed with flexible sheet 20 or may be separately formed and attached relative to flexible sheet 20. Handle 45 may comprise one or more elongated apertures 47 positioned within handle 45 or may comprise a similar configuration that provides an ample area for a consumer to grasp by inserting his hand through and still maintain the purpose and integrity of package 50.

When the preceding embodiment of carrier 10 is assembled into a package 50, the plurality of interconnected bands formed around container apertures 25 within plastic sheet 20 are positioned along the sidewalls of respective containers 60, for instance, approximately 1.5" from a top of each container 60.

Carrier 10 will therefore unitize groups of containers having a range of diameters and a range of sidewall characteristics, including smaller container diameters that require overstretching carrier 10 in both the machine and transverse directions. Carrier 10 according to this invention will permit a single carrier 10 to engage a relatively broad range of existing and conceivable containers.

As described, carrier 10 is preferably engaged and applied to containers 60 by sets of moveable jaws (not shown). These moveable jaws typically engage carrier 10 within container apertures 25 and then stretch carrier 10 for application onto containers 60. As a result of the described embodiment, flap 35 promotes consistent contact with the sidewalls of containers 60, and container apertures 25 are slideable relative to the sidewalls of the respective containers 60 until carrier 10 is applied to containers 60 and jaws are released from container apertures 25. Container apertures 25 are then released into engagement with containers 60 thereby providing a tight engagement relative to the sidewalls. This results in a package having containers 60 tightly and firmly maintained within carrier 10.

Flap 35 preferably permits inner web 30 to form in the shape of a "V" due to the friction created by the extra material comprising flap 35. Absent the "V" shaped inner web 30, inner web 30 tends to invert following some applications giving package 50 a skewed appearance. By consistently applying carrier 10 having flap 35 in this manner, a desirable looking package 50 is consistently created.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

The invention claimed is:

1. A carrier for carrying an array of containers in a corresponding array of container apertures, the carrier comprising:

a plastic sheet having the array of container apertures formed in transversely adjacent pairs therein, the container apertures narrower in a lateral direction than a longitudinal direction; and an inner web positioned between each transversely adjacent pair of container apertures, the inner web including a flap extending into and across a central portion of each container aperture of each adjacent pair of container apertures; and an arrangement of perforations extending across a center of the inner web, wherein, following application of the carrier to the array of containers, the inner web maintains consistent contact with sidewalls of the containers and forms a "V" shape relative to the sidewalls of the containers.

2. The carrier of claim 1 wherein the inner web is symmetrical about the line of weakness.

3. The carrier of claim 1 wherein the flap extends across a central portion of an inner edge of each container aperture.

4. The carrier of claim 1 further comprising:

a handle extending from one longitudinal edge of the plastic sheet.

5. The carrier of claim 1 wherein each container aperture further comprises two generally straight edges extending in a transverse direction of the plastic sheet.

6. A carrier for carrying an array of containers in a corresponding array of container apertures, the carrier comprising:

a plastic sheet having the array of container apertures formed in transversely adjacent pairs therein;

an inner web positioned between each transversely adjacent pair of container apertures, the inner web including a flap extending into and across a central portion of an inner edge of each container aperture of each adjacent pair of container apertures and a line of weakness including an arrangement of perforations bisecting the inner web, wherein, following application of the carrier to the array of containers, the inner web maintains consistent contact with sidewalls of the containers and forms a "V" shape relative to the sidewalls of the containers; and a handle extending from one longitudinal edge of the plastic sheet.

7. The carrier of claim 6 wherein the inner web is symmetrical about the line of weakness.

8. The carrier of claim 6 wherein the flap comprises a generally curved portion that extends across an inner edge of each container aperture.

9. A package of containers formed with a carrier having an array of containers in a corresponding array of container apertures, the package comprising:

a plastic sheet having the array of container apertures formed in transversely adjacent pairs therein, a container positioned within each container aperture of the array of container apertures;

an inner web positioned between each transversely adjacent pair of container apertures, the inner web including a flap extending into and across a central portion of an inner edge of the each container aperture and against a sidewall of each container engaged with each respective container aperture;

a line of multiple perforations bisecting the inner web, wherein the inner web maintains consistent contact with sidewalls of the containers and forms a "V" shape relative to the sidewalls of the containers; and a handle extending from one longitudinal edge of the plastic sheet.

10. The package of claim 9 wherein the line of weakness comprises a series of slits aligned between each container.

11. The package of claim 9 wherein the flap comprises a generally curved portion extending into each container aperture.

* * * * *